US005866488A

United States Patent [19]

Terada et al.

[11] Patent Number: 5,866,488

[45] Date of Patent: Feb. 2, 1999

[54] THERMALLY FUSIBLE COMPOSITE FIBER AND NON-WOVEN FABRIC MADE OF THE SAME

[75] Inventors: Hirokazu Terada; Masayasu Suzuki, both of Shigaken, Japan

[73] Assignee: Chisso Corporation, Osaka, Japan

[21] Appl. No.: 912,194

[22] Filed: Aug. 18, 1997

Related U.S. Application Data

[62] Division of Ser. No. 688,888, Jul. 31, 1996, Pat. No. 5,693,420.

[30] Foreign Application Priority Data

Aug. 7, 1995 [JP] Japan ..... 7-222663

[51] Int. Cl.[6] ..... D02G 3/00

[52] U.S. Cl. ..... 442/362; 442/364

[58] Field of Search ..... 442/362, 364; 526/348.3

[56] References Cited

U.S. PATENT DOCUMENTS 4,788,264 11/1988 Ukita .

5,444,145 8/1995 Brant et al. .

5,693,420 12/1997 Terada et al. .

FOREIGN PATENT DOCUMENTS 63-92722 4/1988 Japan .

2-251612 10/1990 Japan .

*Primary Examiner*—Newton Edwards

*Attorney, Agent, or Firm*—McDermott, Will & Emery

[57] ABSTRACT

A non-woven fabric comprising thermally fusible composite fibers with shortened heat-sealing time and improved heat-sealing strength is provided. The non-woven fabric is produced using side-by-side type or sheath-and-core type thermally fusible composite fibers comprising a first component consisting of polyethylene and a second component consisting of polyester, said polyethylene occupying continuously at least a portion of the surface of the fiber in the length direction, wherein said polyethylene is a copolymer having 1.6/1,000 C or more methyl branches in its molecular chains, a density from 0.940 to 0.965 g/cm$^3$, and a Q value (weight average molecular weight Mw/number average molecular weight Mn) of 4.8 or less.

3 Claims, No Drawings

THERMALLY FUSIBLE COMPOSITE FIBER AND NON-WOVEN FABRIC MADE OF THE SAME

This application is a division of application Ser. No. 08/688,888 filed Jul. 31, 1996, now U.S. Pat. No. 5,693,420.

BACKGROUND OF THE INVENTION

1. Field of the Invention

The present invention relates to a thermally fusible composite fiber, and to non-woven fabric made of such a fiber.

2. Description of the Prior Art

A low-density non-woven fabric of a METSUKE (weight per unit area) between approximately 10 and approximately 45 g/m$^2$ is used as the surface material for paper diapers, sanitary napkins, and the like. As the uses of non-woven fabrics have become diversified, property requirements for non-woven fabrics have become more strict, and there has been demand for non-woven fabrics which maintain high strength at a minimum weight while retaining a soft texture. In the context of such a recent situation, products such as pants-type diapers are required to have a certain strength, and this is accomplished by heat-sealing non-woven fabrics with each other. For this reason, a non-woven fabric having excellent heat-sealing properties is demanded.

In order to satisfy such a demand, it is necessary that the non-woven fabric be constituted of fine, thermally fusible composite fibers, and that the low-melting component contributing to the thermal fusion of thermally fusible composite fibers have sufficient adhesive strength as well as flexibility.

Examples of thermally fusible composite fibers include the combinations of polypropylene and polyethylene, polyethylene terephthalate and polyethylene, and polyethylene terephthalate and poly[(ethylene terephthalate)-co-(ethylene isophthalate). The polyethylene materials include high-density polyethylene, low-density polyethylene, and linear low-density polyethylene.

However, when low-density polyethylene or linear low-density polyethylene is used as the low-melting component of the thermally fusible fibers, the fibers may become adhered to one another at a low temperature, but are easily peeled apart. Also, although the resultant non-woven fabric has a soft feel, it has low strength, low rigidity due to low density, and a sticky feel. For example, Japanese Patent Application Laid-Open No. 63-92722 discloses a. fine thermally fusible composite fiber using linear low-density polyethylene having a low rigidity as the low-melting component, as well as a thermally fusible non-woven fabric comprising such a fiber. However, this fabric has poor heat-sealing properties and a low strength, and does not satisfy the requirements of the non-woven fabric achieving the object of the present invention.

On the other hand, non-woven fabric made of thermally fusible composite fibers in which high-density polyethylene is used as the low-melting component has higher density and rigidity, higher strength, and good heat-sealing properties as compared to non-woven fabrics made of low-density polyethylene and linear low-density polyethylene. However, since the high-density polyethylene used as the low-melting component has a high melting point, the processing temperature must be elevated in order to achieve sufficient non-woven strength and heat-sealing properties. This is disadvantageous in that the resultant non-woven fabric has a stiff feel. Furthermore, although lower non-woven processing temperatures are desirable from the point of view of energy costs, sufficient strength cannot be achieved unless the processing temperature is sufficiently high.

In order to solve such problems, a thermally fusible composite fiber disclosed in Japanese Patent Application Laid-Open No. 2-251612 has as its high-melting component polypropylene or polyester, and as its low-melting component high-density polyethylene, which has many methyl branches in its molecular chain and a relatively low melting point. However, increasing the number of methyl branches in polyethylene generally lowers the density, and increasing the Q value (weight average molecular weight Mw/number average molecular weight Mn) increases the unevenness of the polymer. Both of these effects lower the tensile strength of the low-melting component, lower the adhesive strength of the low-melting component at points where fibers intersect one another, and result in insufficient strength of the fabric itself and of heat sealing.

SUMMARY OF THE INVENTION

It is the object of the present invention to solve the above-mentioned disadvantages in the prior art, and to provide a thermally fusible composite fiber having high strength, having soft feel, and achieving a high heat-sealing strength within a short heat-sealing time.

The inventors of the present invention conducted repeated studies to solve the above problems, and found that a non-woven fabric having a high heat-sealing strength as well as a high fabric strength and a soft feel can be produced by processing into a non-woven fabric a thermally fusible composite fiber having as its low-melting component specific polyethylene. As the result, the inventors found that the desired object was achieved, and completed the present invention.

According to a first aspect of the present invention, there is provided a side-by-side type or sheath-and-core type thermally fusible composite fiber comprising a first component made of polyethylene and a second component made of polyester, said polyethylene occupying continuously at least a portion of the surface of the fiber in the length direction, wherein said polyethylene is a copolymer having 1.6/1,000 C or more methyl branches in its molecular chains, a density from 0.940 to 0.965 g/cm$^3$, and a Q value (weight average molecular weight Mw/number average molecular weight Mn) of 4.8 or less.

According to a second aspect of the present invention, there is provided a thermally fusible composite fiber according to the first aspect, wherein the number of methyl branches in the first component is 5.0/1,000 C or more.

According to a third aspect of the present invention, there is provided a non-woven fabric containing at least 20 percent of side-by-side type or sheath-and-core type thermally fusible composite fibers each comprising a first component made of polyethylene and a second component made of polyester, said polyethylene occupying continuously at least a portion of the surface of the fibers in the length direction, wherein said polyethylene is a copolymer having 1.6/1,000 C or more methyl branches in its molecular chains, a density from 0.940 to 0.965 g/cm$^3$, and a Q value (weight average molecular weight Mw/number average molecular weight Mn) of 4.8 or less, and wherein the intersections of the fibers are thermally fused by polyethylene which is the first component of said thermally fusible composite fibers.

According to a fourth aspect of the present invention, there is provided a non-woven fabric according to the third aspect, wherein the number of methyl branches in the molecular chains of the first component is 5.0/1,000 C or more.

According to a fifth aspect of the present invention, there is provided a formed article produced using thermally fusible composite fibers according to the first or second aspect.

DETAILED DESCRIPTION OF PREFERRED EMBODIMENTS

The present invention will next be described in detail.

The polyester resin used in the high-melting component of the thermally fusible composite fiber of the present invention may be any thermoplastic polyester generally used as the material of fibers. For example, the polyester resin may be polyethylene terephthalate, as well as copolymers such as poly[(ethylene terephthalate)-co-(ethylene isophthalate)], preferably having a melting point between 250° and 260° C. and an inherent viscosity between 0.5 and 1.2 (in the mixed solvent of 60% by weight of phenol and 40% by weight of tetrachloroethane at 30° C.).

Polyethylene used in the present invention must be adjusted so as to have a density from 0.940 to 0.965 g/cm$^3$. Non-woven fabric made of thermally fusible composite fibers having a density exceeding 0.965 g/cm$^3$ tends to have a stiff feel, because of a high processing temperature necessary to achieve high strength. In heat sealing, the sheath component flows easily due to a high stiffness of the low-melting component. Also, since a long time is required before the sheath component starts flowing, the heat sealing temperature must be elevated, or the heat sealing time must be adjusted. On the other hand, although non-woven fabric made of thermally fusible composite fibers having a density of less than 0.940 g/cm$^3$ has a soft feel, high fabric strength and high heat sealing strength cannot be achieved because of a low stiffness of the low-melting component, and therefore, such polyethylene cannot be used. Consequently, from both aspects of strength and feel, the density of the polyethylene material is preferably between 0.940 and 0.965 g/cm$^3$, and most preferably between 0.941 and 0.955 g/cm$^3$. The term "density" used herein is a value obtained by preparing a test piece using compression molding in accordance with JIS K-6758, and subsequently measuring using the density grade tube method in accordance with JIS K-7112.

The polyethylene resin used in the present invention should have a Q value of 4.8 or less, and more preferably 4.0 or less. If the Q value exceeds 4.8, the tensile strength of the woven fabric lowers, the adhesive strength at the point where fibers formed of the high-melting component intersect and adhere to one another by the fusion of the low-melting component becomes insufficient, and non-woven fabric with high strength cannot be produced when the non-woven fabric is produced by the heat treatment and adhesion of the fibers, because of the broad molecular-weight distribution of the polyethylene forming the low-melting component in the fibers. Although there is no lower limit of the Q value, the lowest value which can be attained in the actual production process is considered to be approximately 3. Heat sealing strength corresponding to the tensile strength is achieved if other conditions are identical.

The Q value used herein is the ratio of the weight average molecular weight to the number average molecular weight, as measured using gel permeation chromatography in an o-dichlorobenzene solution at 140° C.

The number of methyl branches in the molecule chains of the polyethylene resin used in the present invention is preferably 1.6/1,000 C or more, and more preferably 5.0/1,000 C or more. When the density is 0.940, the upper limit of the number of methyl branches is estimated to be approximately 10. The methyl branch used herein is a methyl group branched directly from the main chain of polyethylene, and methyl groups not bonded directly to the main chain, such as the end methyl group of an ethyl branch, are not included. The number of methyl branches is the number of methyl groups directly bonded to the main chain of polyethylene per 1,000 carbon atoms in the main chain. Such methyl groups can be determined quantitatively from the nuclear magnetic resonance spectra of carbon atoms having a mass number of 13.

As seen in linear low-density polyethylene, density decreases as the number of not only methyl branches but also any other branches increases in co-polymerized polyethylene. For this reason, since the low-melting components start flowing at a low temperature, the temperature for processing non-woven fabric can be lowered. However, since ethyl branches or branches larger than ethyl branches cause significant lowering of density, a large number of such branches cannot be introduced. Therefore, methyl branches are most preferred for minimizing lowering of density and for introducing a large number of branches. It was thus found that increasing the number of methyl branches is effective for minimizing decrease in tensile strength due to lowering of density, for improving melt-flow properties at low temperatures, and for producing polyethylene with good heat-sealing properties. However, longer branches may be contained if the density is within the range of the present invention.

By heat sealing the thermally fusible composite fibers of the present invention, which has such specific polyethylene as the low-melting component, non-woven fabrics having high heat-sealing strength are produced even at relatively low temperatures.

Co-polymerized polyethylene of the present invention, which meets the above requirements, is produced by co-polymerizing ethylene with a small amount of propylene in the presence of catalysts such as Ziegler-Natta, chromium oxide, molybdenum oxide, and Kaminski-type catalysts using conventional manufacturing processes such as the solution method, the gas-phase method, or the high-temperature high-pressure ionic polymerization method.

Co-monomers used here are not limited to propylene, but may be 1-olefins having 4 or more carbon atoms, which produce a branch longer than a methyl branch. For example, butene-1, pentene-1, hexene-1, 4-methyl pentene-1, heptene-1, octene-1, nonene-1, and decene-1 may be used singly or in combination. Other α-olefins may also be used if they produce a polyethylene having a density and Q value within the range of the present invention, and two or more α-olefins may be used to produce a terpolymer and so on.

Although the melt-flow rate (MFR; 190° C., ASTM D1238(E)) of the polyethylene used in the present invention may be in the range between 5 and 45, the preferable range is between 8 and 28 because of the ease of spinning. For preventing deterioration of the polymer during spinning and for preventing the discoloration of non-woven fabrics, additives used in ordinary polyolefins, such as antioxidants, light stabilizers, and heat stabilizers, as well as colorants, lubricants, anti-static agents, and delustrants may be combined as required.

The thermally fusible composite fibers are spun into side-by-side type yarns, in which polyester, which is the high-melting component; and polyethylene, which is the low-melting component; are arranged in side-by-side type or into sheath-and-core type yarns in which the polyethylene acts as a sheath. The sheath-and-core type yarns may be concentric or eccentric.

The ratio of the high-melting component to the low-melting component is preferably from 30/70 to 70/30 by weight, and more preferably from 40/60 to 60/40 by weight. Other spinning and drawing conditions may be the same as those for composite fibers consisting of ordinary polyester and polyethylene. Although there is no limitation in the single fiber fineness and the number of crimps of the fibers, for balancing fabric strength and feel, the single fiber fineness is preferably from 0.5 to 6.0 denier, more preferably from 1.0 to 3.0 denier; and the number of crimps is preferably from 5 to 30 crimps per inch, more preferably from 10 to 20 crimps per inch.

The non-woven fabric of the present invention is produced from the thermally fusible composite fibers of the present invention alone, or from mixed fibers containing 20 percent by weight or more, preferably 50 percent by weight or more, the thermally fusible composite fibers of the present invention; by webbing such fibers using well-known methods such as carding, air lay, dry pulp, wet paper making, and tow opening methods; and heat-treating the webs for thermally adhering the intersections of the thermally fusible composite fibers.

The methods of heat treatment include methods using a drier such as a hot-air drier, a suction band drier, or a Yankee drier; as well as methods using a roll such as a flat calender roll or an emboss roll.

There is no limitation in the METSUKE of the non-woven fabric, and it can be changed to meet the requirements of applications. When the non-woven fabric is used for the surface material of paper diapers or sanitary napkins, the METSUKE is preferably from 8 to 50 g/m$^2$, and more preferably from 10 to 30 g/m$^2$.

Other fibers which can be used in combination with the thermally fusible composite fibers may be any fibers so long as those fibers are not affected by heat treatment, and they do not affect the object of the present invention. Examples include synthetic fibers such as polyester, polyamide, polypropylene, and polyethylene; natural fibers such as cotton and wool, and fibers such as rayon.

Since the low-melting component of the thermally fusible composite fibers acts as a binder in the non-woven fabric of the present invention, if the content of the thermally fusible composite fibers is less than 20 percent, the number of adhesion points at the intersections of the fibers decreases, and high fabric strength cannot be achieved.

Although the thermally fusible composite fibers and the non-woven fabric made of such composite fibers are suitably used as the surface material of paper diapers, sanitary napkins and the like, these fibers and fabrics may also be applied widely to medical uses such as surgical gowns; civil-engineering materials such as drainage or soil improving materials; industrial materials such as oil absorbers; and household materials such as tray mats for packaging fresh foods including fish and meat.

Furthermore, formed products such as cartridge filters may be produced by thermally fusing the composite fibers of the present invention at higher fiber density than in non-woven fabrics.

The present invention will be described in further detail by referring to Examples and Comparative Examples. Methods for evaluating properties used in each example are as follows: Non-woven fabric strength:

The material short fibers were processed into a web having a METSUKE of about 20 g/cm$^2$ using a miniature carding machine, and passed between metal rolls (upper: emboss roll with 25% boss area, lower: flat roll) having a diameter of 165 mm and keeping a temperature between 120 and 132° C. into a non-woven fabric under the conditions of a linear pressure of 20 kg/cm and a speed of 6 m/min. From the resulting non-woven fabric, test pieces each having a width of 5 cm in the direction of machine movement (MD) and in the direction perpendicular to the machine flow (CD) were prepared, and the tensile strength of each test piece was measured using a tensile tester with a clamp distance of 10 cm and at a pulling speed of 10 cm/min. Heat-sealing properties:

Two test pieces, each having a width of 2.5 cm, were cut from the non-woven fabric used for the above tensile test, and an area of a test piece 1 cm from the end was overlaid on the same area of another test piece, and compressed at a pressure of 3 kg/cm$^2$ and a temperature between 130° and 145° C. for 0.1 second so as to form a composite piece. The peeling strength was measured using a tensile tester under the conditions of a clamp distance of 10 cm and a pulling speed of 10 cm/min. Feel of non-woven fabrics:

Organoleptic tests were performed by five panel members. When all panel members considered that there was no stiff feel due to wrinkling or the like, and that the sample was soft, the sample was evaluated as good (○); when three or more panel members considered as above, the sample was evaluated as (Δ); and when three or more panel members considered that the sample has stiff feel due to wrinkling or the like, or the sample lacked in soft feel, the sample was evaluated as poor (X).

EXAMPLES 1–4 and Comparative Examples 1–3

Polyester (polyethylene terephthalate; PET, inherent viscosity (measured in accordance with JIS Z-8808): 0.65) as the high-melting component was extruded at a temperature of 300° C., and high-density polyethylene (all cases except Comparative Example 3) or low-density polyethylene (Comparative Example 3) listed in Table 1 as the low-melting component was extruded at a temperature of 200° C., at a rate of 282 g of total resins per minute from a sheath-and-core type die having 350 holes, each having a diameter of 0.6 mm, so as to form sheath-and-core type composite fiber, the core of which is polyester and the sheath of which is polyethylene, in the polyester/polyethylene ratio of 6:4 (by weight) and having a single fiber denier number of 6.7 d/f. The yarn was drawn to 3.3 times its original length at 90° C., crimped, heat-treated at 80° C. to control shrinkage, and cut into thermally fusible composite fiber staples having a cut length of 51 mm.

The resultant thermally fusible composite fiber staples were passed through a carding machine, and the web produced was processed into a non-woven fabric using emboss/flat rolls at 120°–132° C.

As Table 2 shows, the non-woven fabrics produced from composite fibers of Examples 1–4 according to the present invention had high fabric strength in both lengthwise (MD) and transverse (CD) directions, high heat-sealing strength, and good feel. However, the non-woven fabrics of Comparative Examples 1 and 3 had low fabric strength, and although the non-woven fabric of Comparative Example 2 had high fabric strength, it had poor feel and its processing temperature was high. Regarding heat-sealing strength, as Table 3 shows, the non-woven fabric of Comparative Example 1 had high heat-sealing strength, but its processing temperature was high; that of Comparative Example 2 had low fabric strength and its processing temperature was high; and that of Comparative Example 3 could be processed at a low temperature, but its strength was low. Example 5 and Comparative Examples 4 and 5

Polyester (polyethylene terephthalate; PET, inherent viscosity: 0.65) as the high-melting component at a extrusion temperature of 300° C., and high-density polyethylene or low-density polyethylene listed in Table 1 as the low-melting component at a extrusion temperature of 200° C., were co-extruded at a rate of 282 g of total resins per minute from a sheath-and-core type die having 350 holes, each having a diameter of 0.6 mm, so as to form sheath-and-core type composite fiber, the core of which is polyester and the sheath of which is polyethylene, in the polyester/polyethylene ratio of 6:4 (by weight) and having a single fiber denier number of 6.7 d/f. The yarn was drawn to 3.3 times its original length at 90° C., crimped, heat-treated at 80° C. to control shrinkage, and cut into thermally fusible composite fiber staples having a cut length of 51 mm.

The resultant thermally fusible composite fiber staples (15–25% by weight) were optionally mixed with polyethylene terephthalate fiber staples of a single fiber denier number of 6 d/f and a fiber length of 51 mm (75–85% by weight), and the mixed staples were passed through a carding machine, and the web produced was heat-treated using emboss/flat rolls at 124°–132° C. to form a non-woven fabric in which the intersections of thermally fusible fibers had been fused.

As Tables 2 and 3 show, thermally fused non-woven fabrics containing 20 percent or more by weight of the composite fibers of the present invention (Examples 5 and 6) had high fabric strength, high heat-sealing strength, and good feel. However, the non-woven fabric of Comparative Example 4 and that of Comparative Example 5 containing not more than 20 percent composite fibers of the present invention, had low strength in the transverse direction (CD).

TABLE 1

| | Properties of fibers | | | | | |
|---|---|---|---|---|---|---|
| | | Low-melting component | | | | |
| | High-melting component | Type *1 | MFR g/10 min | Me branch/1000 C | Density g/cm$^3$ | Q value Mw/Mn |
| Example 1 | PET | A1 | 16 | 6.6 | 0.945 | 4.2 |
| Example 2 | PET | A2 | 15 | 2.5 | 0.955 | 3.5 |
| Example 3 | PET | A3 | 18 | 3.2 | 0.951 | 3.9 |
| Example 4 | PET | A4 | 13 | 7.1 | 0.941 | 4.1 |
| Comp.Ex.1 | PET | a1 | 14 | 1.0 | 0.955 | 5.2 |
| Comp.Ex.2 | PET | a2 | 16 | <0.3 | 0.971 | 3.5 |
| Comp.Ex.3 | PET | b1 | 19 | 12.7 | 0.920 | 6.5 |

*1: Type A: High-density polyethylene according to the present invention (suffixes indicate identification numbers).
a: High-density polyethylene not according to the present invention (suffixes indicate identification numbers).
b: Low-density polyethylene

TABLE 2

| | Conditions of production | | | | Properties | | | |
|---|---|---|---|---|---|---|---|---|
| | | | | | | Fabric strength kg/5 cm | | |
| | Content % | Type | Other fibers | process temp. °C. | MET-SUKE g/m$^2$ | MD | CD | Feel |
| Example 1 | 100 | A1 | — | 124 | 21 | 6.1 | 1.3 | ○ |
| Example 2 | 100 | A2 | — | 128 | 19 | 7.7 | 1.8 | Δ |
| Example 3 | 100 | A3 | — | 128 | 21 | 7.5 | 1.6 | ○ |
| Example 4 | 100 | A4 | — | 124 | 22 | 5.9 | 1.2 | ○ |

TABLE 2-continued

| | Conditions of production | | | | Properties | | | |
|---|---|---|---|---|---|---|---|---|
| | | | | | | Fabric strength kg/5 cm | | |
| | Content % | Type | Other fibers | process temp. °C. | MET-SUKE g/m$^2$ | MD | CD | Feel |
| Comp. Ex. 1 | 100 | a1 | — | 128 | 20 | 5.9 | 0.8 | Δ |
| Comp. Ex. 2 | 100 | a2 | — | 132 | 22 | 8.2 | 1.8 | x |
| Comp. Ex. 3 | 100 | b1 | — | 120 | 19 | 3.9 | 0.5 | ○ |
| Example 5 | 25 | A1 | PET | 124 | 22 | 2.3 | 0.5 | Δ |
| Example 6 | 25 | A4 | PET | 124 | 21 | 2.5 | 0.7 | Δ |
| Comp. Ex. 4 | 25 | a2 | PET | 132 | 23 | 2.8 | 0.8 | x |
| Comp. Ex. 5 | 15 | A1 | PET | 124 | 20 | 1.7 | 0.2 | Δ |

TABLE 3

| | Content % | Type | Other fibers | Heat-sealing temperature °C. | Heat-sealing strength kg/25 mm |
|---|---|---|---|---|---|
| Example 1 | 100 | A1 | — | 135 | 0.580 |
| | | | | 140 | 1.250 |
| | | | | 145 | 1.900 |
| Example 2 | 100 | A2 | — | 135 | 0.300 |
| | | | | 140 | 0.739 |
| | | | | 145 | 1.155 |
| Example 3 | 100 | A3 | — | 135 | 0.516 |
| | | | | 140 | 1.023 |
| | | | | 145 | 1.873 |
| Example 4 | 100 | A4 | — | 135 | 0.623 |
| | | | | 140 | 1.677 |
| | | | | 145 | 1.988 |
| Comparative Example 1 | 100 | a1 | — | 135 | 0.251 |
| | | | | 140 | 0.622 |
| | | | | 145 | 1.136 |
| Comparative Example 2 | 100 | a2 | — | 135 | — |
| | | | | 140 | 0.257 |
| | | | | 145 | 0.829 |
| Comparative Example 3 | 100 | b1 | — | 130 | 0.597 |
| | | | | 135 | 0.652 |
| | | | | 140 | 0.981 |
| Example 5 | 25 | A1 | PET | 130 | — |
| | | | | 135 | 0.226 |
| | | | | 140 | 0.597 |
| Example 6 | 25 | A4 | PET | 130 | — |
| | | | | 135 | 0.279 |
| | | | | 140 | 0.639 |
| Comparative Example 4 | 25 | a2 | PET | 140 | — |
| | | | | 145 | 0.156 |
| | | | | 150 | 0.531 |
| Comparative Example 5 | 15 | b1 | PET | 125 | — |
| | | | | 130 | — |
| | | | | 135 | 0.348 |

By the use of the thermally fusible composite fiber of the present invention using specific polyethylene as the low-melting component, a non-woven fabric having high strength, good heat-sealing properties, and soft feel was produced.

The thermally fusible composite fibers according to the present invention and non-woven fabrics made of such fibers may be used for hygienic materials which are the surface materials of paper diapers, sanitary napkins, and the like; as well as medical materials such as surgical gowns; civil-engineering materials such as draining or soil improving materials; industrial materials such as oil absorbers; and household materials such as tray mats for packaging fresh foods including fish and meat.

What is claimed is:

1. A non-woven fabric containing at least 20 percent of side-by-side type or sheath-and-core type thermally fusible composite fibers each comprising a first component consisting of polyethylene and a second component consisting of polyester, said polyethylene occupying continuously at least a portion of the surface of the fibers in the length direction, wherein said polyethylene is a copolymer having 1.6/1,000 C or more methyl branches in its molecular chains, a density from 0.940 to 0.965 g/cm$^3$, and a Q) value (weight average molecular weight Mw/number average molecular weight Mn) of 3–4.8, wherein said polyethylene copolymer is produced by copolymerizing ethylene and propylene, and wherein the intersections of the fibers are thermally fused by polyethylene which is the first component of said thermally fusible composite fibers.

2. A non-woven fabric according to claim 1, wherein the number of methyl branches in the molecular chains of the first component is 5.0/1,000 C or more.

3. A formed article produced using thermally fusible composite fibers according to claim 1.

* * * * *